United States Patent [19]

Woolley et al.

[11] 4,180,095

[45] Dec. 25, 1979

[54] DISHWASHER FLOAT SWITCH CONTROL ASSEMBLY

[75] Inventors: James M. Woolley, Dayton; Jon F. Berges, Waynesville, both of Ohio

[73] Assignee: White Consolidated Industries, Inc., Cleveland, Ohio

[21] Appl. No.: 949,210

[22] Filed: Oct. 6, 1978

Related U.S. Application Data

[63] Continuation-in-part of Ser. No. 853,318, Nov. 21, 1977, abandoned.

[51] Int. Cl.[2] ..... F16K 31/18

[52] U.S. Cl. ..... 137/387; 73/322.5; 68/207; 68/208; 134/57 D; 137/412; 137/429; 200/34; 200/84 R

[58] Field of Search ..... 73/322.5; 68/207, 208; 134/56 D, 57 D; 137/387, 412, 429, 436; 200/34, 61.2, 84 R

[56] References Cited

U.S. PATENT DOCUMENTS

| | | | |
|---|---|---|---|
| 3,464,437 | 9/1969 | Zane | 137/412 |
| 3,610,271 | 10/1971 | Jarvis | 137/412 |
| 3,643,681 | 2/1972 | Simmons | 137/429 |
| 3,721,783 | 3/1973 | Hancock | 200/84 R |
| 3,829,636 | 8/1974 | Scott | 200/61.2 |
| 3,885,580 | 5/1975 | Cushing | 137/387 |
| 3,894,555 | 7/1975 | Payne | 137/412 |

*Primary Examiner*—Martin P. Schwadron
*Assistant Examiner*—G. Walton
*Attorney, Agent, or Firm*—Pearne, Gordon, Sessions

[57] ABSTRACT

A float support includes a guide sleeve extending upwardly from a dishwasher chamber sump for slidable reception of a float stem. The support includes a hollow standpipe having an upper portion, partially defined by an external wall of the guide sleeve along part of its axial height, and a lower portion extending down through the sump in an offset manner. The inverted cuplike float includes a plurality of cavities at least one of which is adapted to entrap air to provide buoyance to the float. A remaining one of the cavities defines a combined float damping and overflow cavity which conceals the upper portion of the hollow standpipe such that the standpipe establishes an air break path between the overflow cavity and atmosphere thereby damping the vertical travel of the float.

2 Claims, 8 Drawing Figures

DISHWASHER FLOAT SWITCH CONTROL ASSEMBLY

This is a Continuation-in-Part of U.S. patent application Ser. No. 853,318, filed Nov. 21, 1977, now abandoned.

This invention relates to a float switch control assembly for a dishwasher, and more particularly to such a float assembly having both air breaK characteristics to provide a damping effect together with a concealed liquid overflow path for the dishwashing chamber.

Float controls for liquid fill systems in dishwashers are well known in the prior art. U.S. Pat. No. 3,829,636 to E. W. Scott discloses a float apparatus for a dishwasher which provides chambers which are open both above and below the water line on the float permitting ingress of water into the chambers with the lower opening sized so as to limit the egress of the contained water to effectually damp vertical fluctuations in the float as it rides on the turbulent water. The Scott float hollow central post includes openings above the water line providing a siphon break to the space between the guide-tube and the float post portion so that the space cannot support a siphon-sustained flow path. However, in the case of a malfunction of the dishwasher fill valve itself, it is possible for the dishwasher to continue to fill the wash chamber and eventually overflow so as to damage the mechanism in the machinery compartment.

It is an object of the present invention to provide an improved float control assembly for a liquid fill system which includes a standpipe portion integral with the float support concealed within the float to provide an air-break path between a float overflow cavity and the atmosphere providing a dampening effect so as to minimize the bobbing of the float adjacent the liquid surface.

It is another object of the present invention to provide a float control assembly which will be substantially responsive to a predetermined desired liquid level as set forth in the prior object having the characteristics wherein the concealed standpipe portion allows liquid overflow to be directed to a predetermined disposal area to obviate damage to the operating components of the dishwasher.

Further objects and advantages of the present invention will be apparent from the following description, reference being had to the accompanying drawings wherein preferred embodiments of the present invention are clearly shown.

Figure 1:
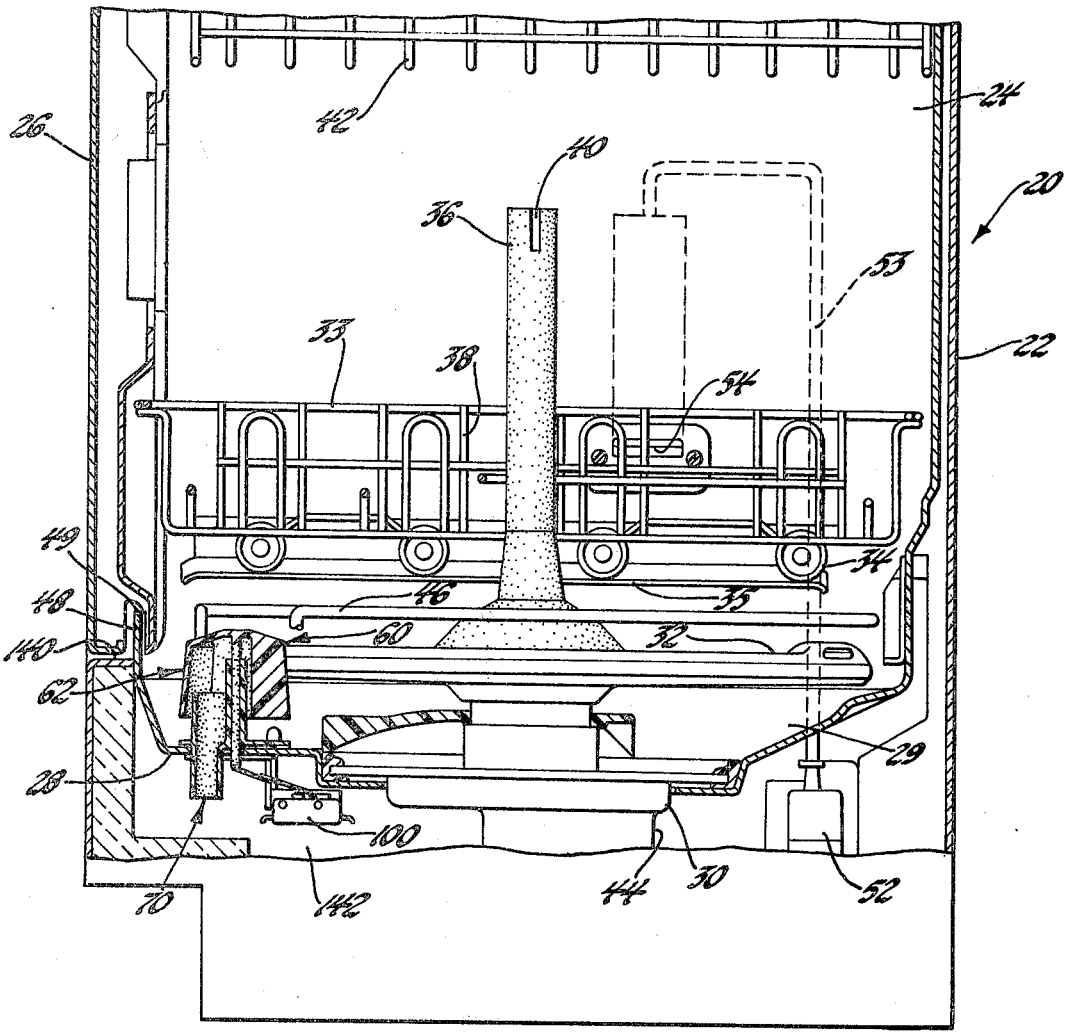
FIG. 1 is a fragmentary elevational view of a dishwasher with portions broken away to show the general location of one embodiment of a float assembly of the present invention.

For the purpose of illustrating one application of the present invention, there is shown in FIG. 1 a portion of a dishwasher illustrated generally at 20. The dishwasher 20 is comprised of casing means 22 defining a dishwashing chamber 24 closed at the front thereof by dishwasher door 26 and having a bottom wall 28 forming a depressed tub sump or liquid container 29 leading to a pump motor assembly 30 which may be of the type taught in U.S. Pat. No. 3,265,311, issued Aug. 9, 1966. In general, the water distribution system includes a revolvable spray arm 32 beneath the lower rack 33 supported on rollers 34 operating on a track 35. A rotating spray column or spray tube 36 is affixed to said spray arm and extends upwardly through a guard portion 38 of the lower rack. The spray tube has an outlet 40 adapted to project a spray generally upwardly through the support wire network of an upper dishrack 42. A reversible motor 44 in the pump motor assembly 30 directly drives the pump in one direction to recirculate the water for washing or rinsing, and, when reversed pumps the water to drain. A heater 46 provides recovery heat to the wash and rinse water and for adding heat to the chamber for the drying cycle.

Figure 3:
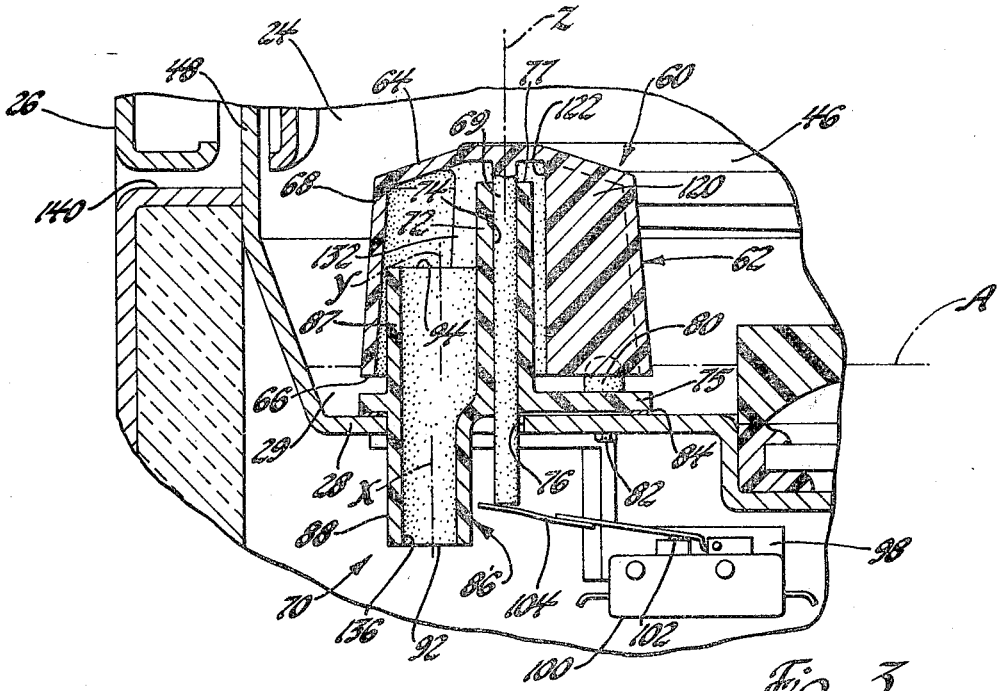
FIG. 3 is a view similar to FIG. 2 with the float in its normal fill level or switch closed position.

The sump 29 is sized to contain about 2.7 gallons of water standing in a quiescent state at normal fill level, indicated at "A" in FIG. 3. The sump 29 is formed with a raised ledge or wall 48 defining along the upper edge 49 thereof a maximum or prior art overflow level whereat the sump previously could reach a capacity within the range of 4.5 to 5 gallons before spilling outside the dishwasher cabinet.

Water is supplied to sump 29 by means of a solenoid actuated water fill valve 52 which controls the flow of liquid through supply pipe 53 and then through an opening 54 in the dishwashing chamber 24 leading to the sump 29 of the dishwasher. Specification for fill valve 52 calls for supply of water at a rate of 1.6 gallons per minute from a domestic water supply having supply pressures between 20 pounds per square inch (psi) and 120 psi.

In the above-described dishwasher, it is customarily desired to stop the inflow of liquid when the liquid reaches the predetermined level A within the sump 29. Frequently, it is desired that this fill control operate satisfactorily even when the pump is in operation circulating liquid in the dishwashing chamber. The present invention provides flow control means for this purpose which includes a first embodiment of an improved float control assembly designated generally by the reference numeral 60.

The float control assembly 60 includes a float generally indicated at 62 in the general form of an inverted cup which may be formed with a suitable lightweight plastic material such as polypropylene, for example. The float includes a closed top wall 64, a downwardly facing open bottom 66 and slightly conical side wall 68. The float top wall 64 integrally connects to downwardly extending elongated central control actuating rod or stem 69 located on the principal axis of the float.

A float support, generally indicated at 70, includes a central sleeve 72 having a bore 74 therethrough dimensioned for slidable reception of the float stem 69. The float support 70 is mounted on the sump bottom wall 28 by means of an outwardly extending circumferential bottom or base flange 75 positioned over a circular opening 76 in sump bottom wall 28. The base flange 75 has a plurality of circumferentially-spaced integral hollow bosses 80, which in the disclosed form are four in number, positioned for threadably receiving screws 82. Tightening of screws 82 compresses annular gasket 84 and sealingly secures base flange 75 against the sump bottom wall 28.

Figure 4:
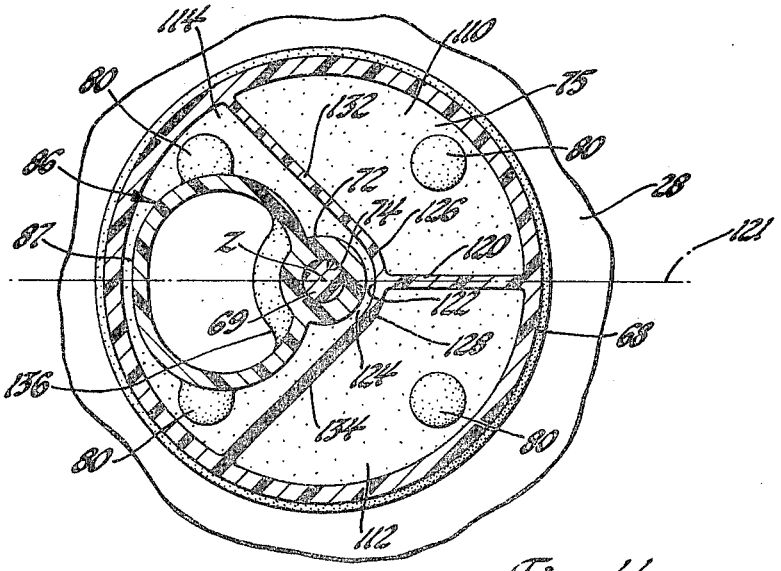
FIG. 4 is an enlarged horizontal sectional view taken substantially on the line 4—4 of FIG. 2.

The float support 70 includes a hollow standpipe, generally indicated at 86, having upper 87 and lower 88 interconnected portions. As seen in FIG. 4, the upper portion 87 of the standpipe 86 has a generally oval cross section partially defined by an external wall section of the guide sleeve 72 along a part of the axial height of the sleeve 72 above the sump bottom wall 28. The standpipe lower portion 88 has a circular cross section and is formed on a vertical axis "X" offset radially outwardly from the principal axis "Y" of the standpipe upper portion 87. It will be noted in FIG. 3 that the standpipe lower portion bottom open end 92 is located a predetermined distance below the sump bottom wall 28 and its upper open end 94 is located a predetermined height above the quiescent water surface level "A". FIG. 3 shows a switch mounting bracket 98 suitably secured to a lower portion of the sump wall such as by bolt and nut assemblies, with the bracket supporting normally open switch means such as a switch generally indicated at 100.

In the embodiment of FIGS. 1–4 the switch 100 is a sensitive microswitch of the single throw-single pole type connected between an electrical power supply and the fill valve solenoid to provide the necessary control of the water fill valve 52. The switch 100 is provided with an operating plunger or button 102 preferably spring pressed upwardly against an operating lever or arm 104 extending over the top of the button 102 laterally across the axis of the standpipe in the linear guide means. The rod 69 extends downward through the hollow interior or bore 74 of the sleeve 72 and is guided thereby to rest upon or otherwise outwardly connect with the operating lever 104 of the switch. As seen in FIG. 3 with actuator arm 104 in its lowered position the button 102 is depressed and the switch 100 is closed. The weight of the float 62 holds the switch 100 closed during normal operation of the dishwasher as shown in FIG. 3.

As stated in U.S. Pat. No. 3,643,681 to Simmons and assigned to the assignee of the present application, fill valve float controls operate satisfactorily when the liquid is relatively quiescent within the tub. During fill and recirculation periods, however, when the liquid is churning and recirculating rapidly, there is considerably turbulence in the dishwashing chamber. Such turbulence causes an undampened float to bob rapidly up and down thereby causing erratic and false indications of the liquid level in the sump and momentarily making and breaking the contacts of the switch 100.

In order to eliminate or minimize this rapid up and down movement or bobbing of the float, it was found that the interior of the float could be divided into a plurality of separate chambers or cavities by means of internal radially disposed partitions. As disclosed in the prior art U.S. Pat. No. 3,829,636 issued Aug. 13, 1974 to Scott, certain of the cavities provide buoyancy to the float by entrapping air therein while certain other cavities act in the manner of a dash-pot by having apertures in the float top wall permitting air to enter and exit the apertured cavities to reduce the buoyancy of the float and thereby to stabilize the float's vertical fluctuations.

The present invention provides a unique float construction which includes vertical integrally molded wall sections depending from the closed top wall 64 of the float. As seen in FIG. 4, the wall sections divide the float into a plurality of cavities at least a pair of which, shown at 110 and 112, are adapted to entrap air to provide buoyancy for the float. The remaining cavity, indicated at 114 in FIG. 2, is an unequal larger sized cavity defining a combined float damping and overflow cavity of a predetermined size to telescopically receive in symmetrical fashion therein the upper portion of the hollow standpipe 87.

In the form of the invention disclosed in FIGS. 1–4 the wall sections have a "Y" configuration in section with a first stem wall section 120 located on a diametral axis 121 of the float so as to terminate at its inboard vertical free end 122 offset from the principal axis "Z" of the float by a predetermined amount. In this manner a clearance space 124 is provided between the outer surface of the sleeve 72 and arcuate wall sections 126 and 128 joined to the pair of wall sections 132 and 134 formed in mirror image relation about the diametral axis 121.

Figure 2:
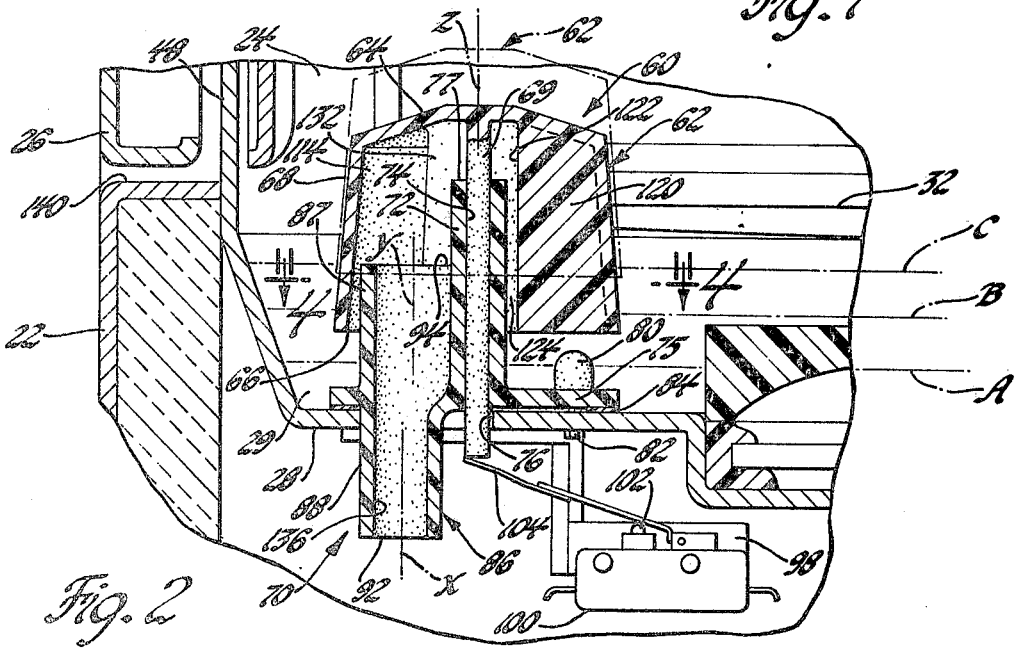
FIG. 2 is an enlarged vertical sectional view of the float assembly of FIG. 1 with the float being shown in its trip-level or switch open position.

As best seen in FIGS. 2 and 3, the standpipe upper open end 94 is positioned at a predetermined height below sleeve upper open end 77 and above the predetermined quiescent liquid level surface "A". Thus, under normal conditions the standpipe 86 establishes an air break passage 136 between the overflow cavity 114 and atmosphere to prevent air entrapment therein. In this manner a dampening effect is provided during the rise and fall of the float 62, between its normal fluctuating range of quiescent level "A" and the switch trip liquid level "B" so as to obviate the momentary making and breaking of the contacts of the switch 100.

Applicants' invention provides an additional function in the event that a liquid overflow condition arises upon the liquid level reaching "overflow" level C because of a failure in the fill system caused, for example, by the fill-valve solenoid being stuck so as to hold the fill-valve in its open position, resulting in a possible liquid spillage situation existing in the dishwasher sump 29 or chamber 24. In such a happening, prior to the liquid level approaching the chamber spillage level, indicated by wall edge 49, the float 62 rises to its uppermost "overflow" level, indicated at its dotted line position in FIG. 2. At this uppermost float position the liquid is at or above level "C" wherein the standpipe passage 136 serves as a concealed liquid overflow path from the sump 29 allowing liquid to enter through the upper open end 94 of the standpipe and exit out its lower open end 92. Thus, the float 62 provides a concealed location for the standpipe 70 at a front corner of the cabinet sump adjacent the access door opening 140 insuring protection against fill valve failure. That is to say, the standpipe allows overflow liquid to be directed, by suitable means such as by a flexible drain hose, not shown, connected over the standpipe lower open end 92, to a suitable disposal area such as an existing outside drain, collection basin or the like. In this manner the standpipe 70 functions in combination with the float 62 to insure against damage to the dishwasher motor 44 and other operating components in the machinery compartment 142.

FIGS. 5–8 show a second embodiment of the subject invention wherein an improved float control assembly, designated generally at 150, is located on the dishwasher bottom wall 28 forming the sump 29 in a manner similar to the float control assembly 60 of FIGS. 1–4.

The float control assembly 150 includes a float generally shown at 152 in the general form of an inverted cup preferably formed of suitable plastic material. The float 152 includes a closed top wall 154, a downwardly facing open bottom 156 and a slightly conical side wall 158. The float top wall 154 integrally connects to a downwardly extending elongated control actuating rod or stem 159 located or aligned on the principal vertical axis of the float assembly.

A float support, generally indicated at 160, includes a central sleeve 162 having a bore 164 therethrough dimensioned for slidable reception of the float stem 159. The float support 160 is mounted on the sump bottom wall 28 by means of a cylindrical base rim 165 positioned in concentric fashion over a circular opening 166 in sump bottom wall 28. A gasket or seal ring 167 of suitable elastomeric material is positioned between the base rim 165 and the bottom wall 28. The base rim 165 has a plurality of circumferentially spaced holes 170 adapted to threadably receive screws 172 to sealingly secure rim 165 against gasket 163.

Figure 5:
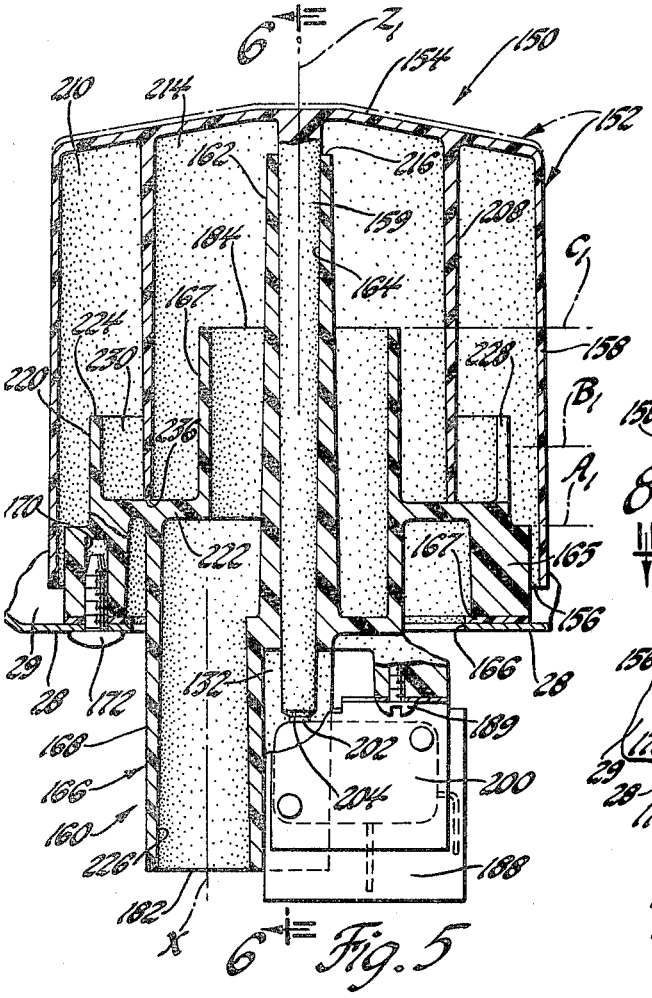
FIG. 5 is a vertical sectional view taken on line 5—5 of FIG. 7 showing a second embodiment of the present invention.
Figure 6:
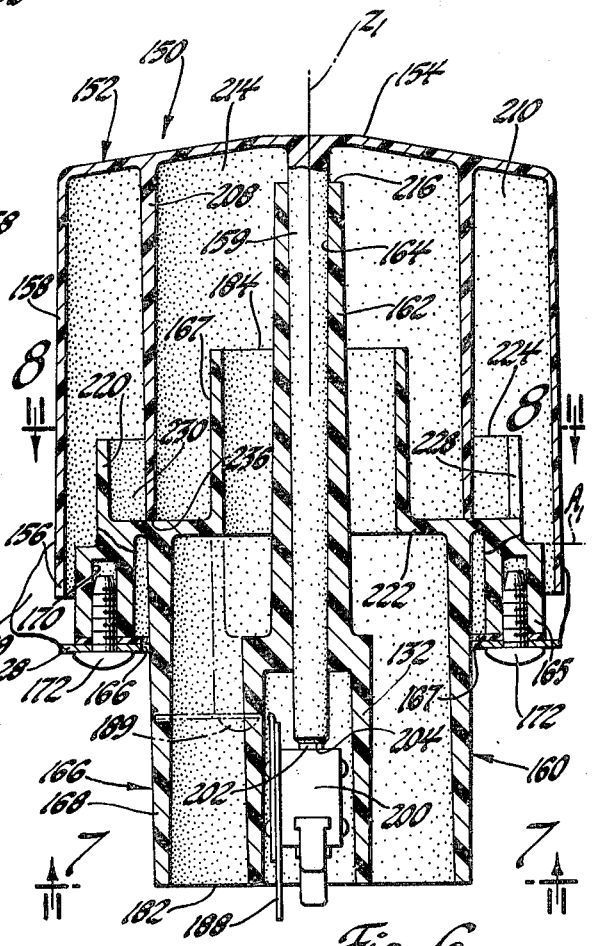
FIG. 6 is a vertical sectional view showing the float assembly of FIG. 5 taken on line 6—6 of FIG. 5.
Figure 7:
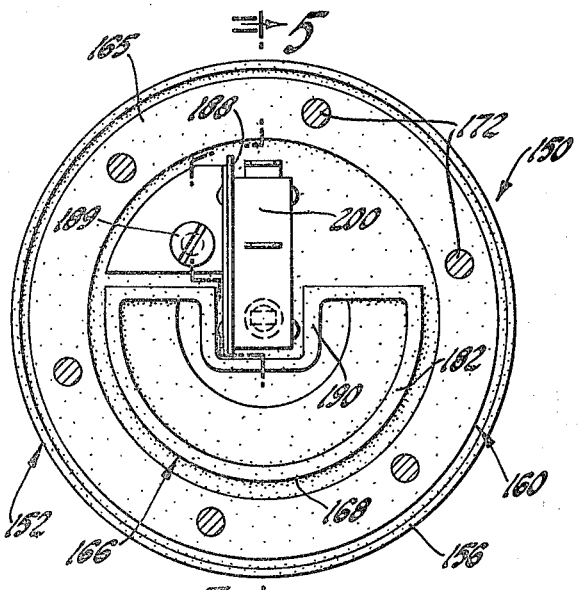
FIG. 7 is a bottom elevational view of the float switch control assembly taken on line 7—7 of FIG. 6.

The float support 160 includes a hollow standpipe, generally indicated at 166, having upper 167 and lower 168 interconnected portions. As indicated in FIGS. 5 and 6, the upper portion 167 of the standpipe 166 has a circular cross section concentric with the central sleeve 162 so as to be partially defined by the external wall section thereof along a part of the axial height of the sleeve 162 above the sump bottom wall 28. The standpipe lower portion 168 has a generally C-shaped cross section and is formed symmetrical with a vertical axis "X", offset radially outwardly from the principal axis "$Z_1$" of the standpipe upper portion 167. It will be noted in FIG. 5 that the standpipe lower portion bottom open end 182 is located a predetermined distance below the sump bottom wall 28 and its upper open end 184 is locates a predetermined height above the normal fill quiescent water surface level "$A_1$". FIGS. 5 and 6 show a switch mounting bracket 188 suitably secured to a lower portion of the sleeve, such as by bolt and nut assemblies 189, with the bracket supporting normally open switch means such as a switch generally indicated at 200. The sleeve 162 has its lower portion 190 formed into a U-shaped section (FIG. 7) to allow the housing of switch 200 to be received therein.

In the embodiment of FIGS. 5–8 the switch 200 is a sensitive microswitch of the single throw-single pole type connected between an electrical power supply and the fill valve solenoid to provide the necessary control of the water fill valve 52. The switch 200 is provided with an operating plunger or button 202 aligned on the float stem axis "$Z_1$" and spring biased upwardly against the free bottom end 204 of the float stem 159. As seen in FIGS. 5 and 6 with the float 152 in its lower operating position the button 202 is depressed and the switch 200 is closed. Thus, the weight of the float 152 holds the switch 200 closed during normal operation of the dishwasher.

Figure 8:
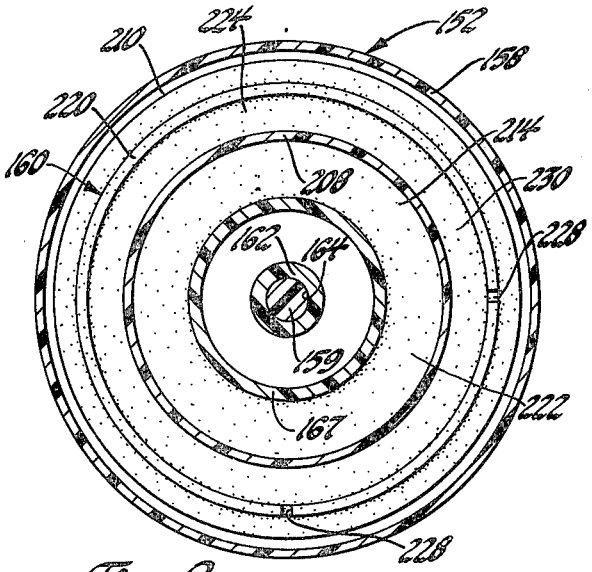
FIG. 8 is a horizontal sectional view taken on the line 8—8 of FIG. 6.

In a manner similar to the embodiment of FIGS. 1–4 the interior of the float 152 is divided into a plurality of separate chambers or cavities by means of outer float side wall 158 and internal wall means in the form of vertically extending wall section or partition 208 concentrically disposed about the stem 159 and integrally molded with the float so as to depend from the closed top wall 154 of the float. As seen in FIGS. 5, 6 and 8 the wall sections 158 and 208 divide the float into a plurality of cavities at least the outer one of which, shown at 210, is adapted to entrap air to provide buoyancy for the float at a predetermined water level. The remaining inner overflow cavity, indicated at 214 in the form of FIGS. 5–8, is a larger sized cavity defining a combined float damping and overflow cavity of a predetermined size to telescopically receive in symmetrical fashion therein the upper portion 167 of the hollow standpipe 160.

As seen in FIGS. 5 and 6, the standpipe upper open end 184 is positioned at a predetermined height below sleeve upper open end 216 and a predetermined height above the quiescent normal fill liquid level surface "$A_1$". Thus, under normal operating conditions the standpipe 166 establishes an air break passage 236 between the overflow cavity 214 and atmosphere to prevent air entrapment in cavity 214. In the same manner as the embodiment of FIGS. 1–4, a dampening effect is provided during the rise and fall of the float 62, between its normal operating position shown in FIGS. 5 and 6 with the water at level "$A_1$" and the switch trip open liquid level "$B_1$" so as to obviate the momentary making and breaking of the contacts of the switch 200.

As in the first embodiment of FIGS. 1–4, applicants' form of the invention shown in FIGS. 5–8 provides an additional function in the event that a liquid overflow condition arises wherein the liquid level reaches "overflow" level "$C_1$" because of a failure in the fill system. As explained above, such an occurrence could arise by the fill-valve solenoid being stuck. In such a happening, prior to the liquid level approaching the chamber spillage level, indicated by wall edge 49 in the embodiment of FIG. 1, the float 152 rises to its switch 200 tripping or switch opening level, indicated by the dotted line position 152 in FIG. 5. At this float switch trip position if the liquid achieves the overfill level indicated at "$C_1$" the standpipe passage 236 serves as a concealed liquid overflow path from the sump 29 wherein liquid enters through the upper open end 184 of the standpipe and exits its lower open end 182.

It will be noted in FIGS. 5 and 8 that the float support 166 has an annular or circular upstanding flange 220 formed at the periphery of its radial flange 222. The upstanding flange 220 is shown concentric with the float support sleeve 162 and of a height such that its upper edge 224 is positioned a predetermined distance above the switch tripping water level "$B_1$". With the float 152 in its normal operating position it will be seen that the lower edge 226 of circular wall partition 208 engages the upper surface of radial flange 222 to form a seal therewith. Thus, during normal operation water is prevented from entering the overflow chamber 214 in sufficient quantities to enter the standpipe upper open end 174.

With the float elevated to its trip position, however, the float partition edge 226 is spaced above the radial flange 222 creating a water flow passage between the outer cavity 210 and the inner cavity 214. Applicants have provided a plurality of vertically extending slots 228 in the vertical flange 220 to allow any water that happens to accumulate within the flange channel 230 to escape and return to the sump.

While the embodiment of the invention as herein disclosed constitutes a preferred embodiment, it is to be understood that other forms might be adopted.

The embodiments of the invention in which an exclusive property or privilege is claimed are defined as follows:

1. In combination with a dishwasher including a dishwashing chamber having a bottom wall portion forming a sump, fill valve means for filling said sump with liquid to a predetermined surface level, and means for circulating said liquid in said chamber, a switch assembly operatively connected to an electrical control circuit of the dishwasher, a float assembly for said fill valve means including a float adapted to float adjacent the surface of said liquid, a float support guide sleeve mounted on the bottom wall portion of said sump, said float having an elongated central stem extending on the principal axis of said float and dimensioned for slidable reception in said sleeve, said sleeve operative for guiding said float substantially in a predetermined linear path perpendicular to said liquid surface as the level of said liquid surface increases to said predetermined surface level, the improvement wherein said float support guide sleeve includes a hollow standpipe having upper and lower interconnected portions, said upper portion being partially defined by an external wall of said guide sleeve along a part of the axial height of said sleeve above said bottom wall portion, said standpipe lower portion formed on a vertical axis offset radially outwardly from the axis of said standpipe upper portion, said standpipe lower portion having its bottom open end located below said bottom wall portion and its upper open end located at a predetermined height above said predetermined surface level, said float in the form of an inverted cup including a closed top, a downwardly facing open bottom and a side wall; switch actuator means engaged with the free end of said stem operating said switch means as said float rises and falls with variations in the liquid level in said sump, wall sections depending from the closed top of said float intermediate said stem and float side wall dividing said float into a pair of opposed unequal sized cavities and a pair of opposed equal sized cavities, both of said equal sized cavities and one of said unequal sized cavities adapted to entrap air to provide buoyancy for said float, the other of said unequal sized cavities defining a combined float-damping and overflow cavity of a predetermined size to telescopically receive therein the upper portion of said hollow standpipe, said standpipe upper open end positioned at a predetermined height below said sleeve upper open end and about said predetermined liquid surface level, whereby under normal conditions said standpipe establishes an air-break path between said overflow cavity and atmosphere to provide a damping effect during the rise and fall of said float, and whereby upon liquid overflow conditions existing in said dishwashing chamber said standpipe provides a concealed liquid overflow path from said chamber allowing overflow liquid to be directed to a predetermined disposal area to obviate damage to operating components of said dishwasher.

2. In combination with a dishwasher including a dishwashing chamber having a bottom wall portion forming a sump, fill valve means for filling said sump with liquid to a predetermined surface level, and means for circulating said liquid in said chamber, switch means operatively connected to an electrical control circuit of the dishwasher, a float assembly for said fill valve means including a float adapted to float adjacent the surface of said liquid, a float support guide sleeve mounted on the bottom wall portion of said sump, said float having an elongated central stem extending on the principal axis of said float and dimensioned for slidable reception in said sleeve, said sleeve operative for guiding said float substantially in a predetermined linear path perpendicular to said liquid surface as the level of said liquid surface increases to said predetermined surface level, the improvement wherein said sleeve includes a hollow standpipe having upper and lower interconnected portions, said standpipe upper portion being at least partially defined by an external wall of said guide sleeve along a part of the axial height of said sleeve above said bottom wall portion, said standpipe lower portion formed on a vertical axis offset radially outwardly from the axis of said standpipe upper portion, said standpipe lower portion having its bottom open end located below said sump bottom wall portion and its upper open end located at a predetermined height above said predetermined surface level, said float in the form of an inverted cup including a closed top, a downwardly facing open bottom and a side wall; switch actuator means engaged with the free end of said stem operating said switch means as said float rises and falls with variations in the liquid level in said sump, wall means depending from the closed top of said float intermediate said stem and float side wall dividing said float into a plurality of cavities, at least one of said cavities adapted to entrap air to provide buoyancy for said float, at least one of the remaining plurality of cavities defining a combined float-damping and overflow cavity of a predetermined size to telescopically receive therein the upper portion of said hollow standpipe, said standpipe upper open end positioned at a predetermined height below the upper open end of said sleeve and a defined distance above said predetermined surface level, whereby under normal operating conditions said standpipe establishes an air-break path between said overflow cavity and atmosphere to provide a damping effect during the rise and fall of said float, and whereby upon liquid overflow conditions existing in said dishwashing chamber said standpipe provides a concealed liquid overflow path from said chamber allowing overflow liquid to be directed to a predetermined disposal area to obviate damage to operating components of said dishwasher.

* * * * *